US006321858B1

(12) United States Patent
Wentworth et al.

(10) Patent No.: US 6,321,858 B1
(45) Date of Patent: Nov. 27, 2001

(54) BIT FOR DIRECTIONAL DRILLING

(75) Inventors: Steven W. Wentworth, Brookfield; Robert F. Crane, Oconomowoc, both of WI (US)

(73) Assignee: Earth Tool Company, L.L.C., Oconomowoc, WI (US)

( * ) Notice: Subject to any disclaimer, the term of this patent is extended or adjusted under 35 U.S.C. 154(b) by 0 days.

(21) Appl. No.: 09/493,641

(22) Filed: Jan. 28, 2000

(51) Int. Cl.[7] ..... E21B 7/04; E21B 10/16

(52) U.S. Cl. ..... 175/61; 175/365; 175/376; 175/398; 175/399

(58) Field of Search ..... 175/61, 73, 376, 175/365, 398, 399, 400

(56) References Cited

U.S. PATENT DOCUMENTS

| | | | | |
|---|---|---|---|---|
| 1,010,144 | * | 11/1911 | Hughes | 175/349 |
| 2,915,291 | * | 12/1959 | Gulfelt | 175/348 |
| 3,094,177 | | 6/1963 | Williams, Jr. | 175/334 |
| 3,825,081 | * | 7/1974 | McMahon | 175/73 |
| 4,763,736 | * | 8/1988 | Varel, Sr. | 175/341 |
| 4,832,143 | * | 5/1989 | Kaalstad et al. | 175/365 |
| 5,148,880 | | 9/1992 | Lee et al. | 175/393 |
| 5,242,026 | | 9/1993 | Deken et al. | 175/62 |
| 5,392,868 | | 2/1995 | Deken et al. | 175/62 |
| 5,449,046 | * | 9/1995 | Kinnan | 175/24 |
| 5,628,585 | | 5/1997 | Parish, II et al. | 405/154 |
| 5,839,525 | | 11/1998 | Hoffmaster et al. | 175/375 |
| 5,924,500 | | 7/1999 | Puttmann | 175/61 |
| 5,941,322 | * | 8/1999 | Stephenson et al. | 175/62 |

OTHER PUBLICATIONS

Rhino Rock Bit, website—http://www.ditchwitch.com/Equipment/Parts/Downhole$_{13}$Tools/bits/rhino.htm, 1 page.
Sharewell—Directional Drilling Systems, "The Lo–Torque Hole Opener" brochure, 11 pgaes.

* cited by examiner

*Primary Examiner*—Hoang Dang
(74) *Attorney, Agent, or Firm*—Philip G. Meyers; Intellectual Property Law, P.C.

(57) ABSTRACT

An improved drill bit for directional drilling includes a housing or headpiece having means at a rear end thereof for mounting the bit on a trailing component of a drill head, and passages for ejection of drilling fluid into a borehole. A first axle is mounted to extend forwardly from a front end of the housing, and a first roller is rotatably mounted on the first axle. The first roller has cutting projections such as carbide studs thereon and extends outside of the outer diameter of the housing by a distance which defines the size of the borehole when the drill bit is rotated over 360 degrees. A second axle is mounted to extend from the front end of the housing, and a second roller is rotatably mounted on the second axle at a position offset from the first axle. The second roller extends slightly outside of the outer diameter of the housing, but by a distance less than the distance the first roller extends outside of the housing. The second roller is configured to provide a reaction surface for the first roller as the first roller bores the borehole with the cutting projections.

20 Claims, 2 Drawing Sheets

BIT FOR DIRECTIONAL DRILLING

TECHNICAL FIELD

The invention relates to a method and bit for directional drilling.

BACKGROUND OF THE INVENTION

Directional boring apparatus or trenchless drills for making holes through soil are well known. The directional borer generally includes a series of drill rods joined end to end to form a drill string. The drill string is pushed or pulled though the soil by means of a powerful device such as a hydraulic cylinder. The drill string may be pushed and rotated at the same time. A spade, bit or head having one or more angled faces configured for boring is disposed at the end of the drill string and may include an ejection nozzle for water or drilling mud to assist in boring.

In one known directional boring system, the drill bit is pushed through the soil without rotation in order to steer the tool by means of the angled face, which is typically a forwardly facing sloped surface. For rocky conditions, a row of teeth may be added to the drill bit and the bit operated in the manner described in Runquist et al. U.S. Pat. No. 5,778,991. Other toothed bits for directional boring through rock are shown in European Patent Applications Nos. EP 0 857 852 and EP 0 857 853, Cox U.S. Pat. No. 5,899,283, Skaggs U.S. Pat. No. 5,647,448 and Stephenson U.S. Pat. No. 5,799,740. Steering systems for use with these devices require keeping track of the angle of rotation of the sloped face of the bit and/or the teeth.

According to anothervknown system, a transmitter or sonde mounted in a tubular housing is mounted behind and adjacent to the bit and sends a signal that indicates the angle of rotation of the bit. The sonde is mounted in a predetermined alignment relative to the steering portion of the bit. Since the sonde housing is generally made of steel, a series of longitudinal slots or windows are provided through the wall of the sonde housing to permit transmission of the signal.

Boring machines such as the foregoing have difficulty penetrating cobble soil conditions where smalls stones are mixed in with soil. Mud motor driven boring machines presently available often provide the best penetration through cobble, but are highly expensive and difficult to run. The mud required to drive the mud motor must be supplied in large quantity and the motor itself must be completely rebuilt after a relative short useful life. A need persists for a directional boring bit that can handle a wide variety of soil conditions including cobble, and which can, when necessary, drill through solid rock. To date, no single bit design can perform all of these functions both effectively and economically.

SUMMARY OF THE INVENTION

The present invention provides an improved drill bit for directional drilling. The bit of the invention includes a housing or headpiece having means at a rear end thereof for mounting the bit on a trailing component of a drill head, and passages for ejection of drilling fluid into a borehole. Such means may, for example, be a threaded projection or cavity or a splined projection or cavity as described below, among others. A first axle is mounted to extend forwardly from a front end of the housing, and a first roller is rotatably mounted on the first axle. The first roller has cutting projections such as carbide studs thereon and extends outside of the outer diameter of the housing by a distance which defines the size of the borehole when the drill bit is rotated over 360 degrees. A second axle is mounted to extend from the front end of the housing, and a second roller is rotatably mounted on the second axle at a position offset from the first axle. The second roller extends slightly outside of the outer diameter of the housing, but by a distance less than the distance the first roller extends outside of the housing. The second roller is configured to provide a reaction surface for the first roller as the first roller bores the borehole with the cutting projections.

A method for boring using such a bit includes rotating the bit continuously over 360° to bore straight ahead with the first and second rollers in contact with the wall of the borehole, and pivoting the first roller back and forth over a limited arc of rotation with the first and second rollers in contact with the wall of the borehole in order to deviate the borehole in the direction of the arc. Fluid is ejected from orifices in the front of the housing to lubricate the bore during drilling. These and other aspects of the invention are described in detail below.

BRIEF DESCRIPTION OF THE DRAWINGS

In the accompanying drawings, wherein like numerals denote like elements.

Figure 1:
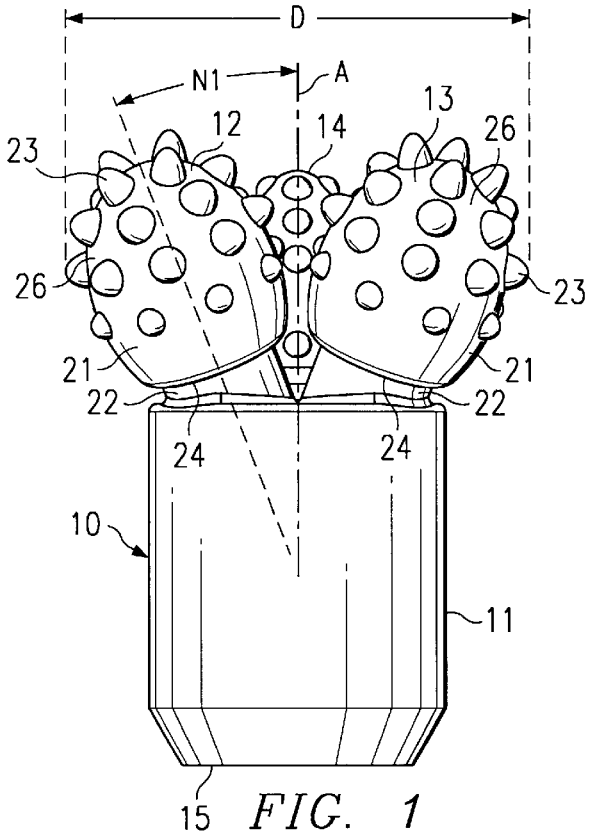
FIG. 1 is a top view of a drill bit according to the invention.

While the making and using of various embodiments of the present invention are discussed in detail below, it should be appreciated that the present invention provides many applicable inventive concepts which can be embodied in a wide variety of contexts. The embodiments discussed herein are merely illustrative of specific ways to make and use the invention and do not limit the scope of the invention.

DETAILED DESCRIPTION OF THE INVENTION

Referring now to FIGS. 1 to 4, a drill bit 10 according to the invention for use in a directional drilling apparatus includes a cylindrical housing 11 on which a pair of inclined rollers 12, 13 and a reaction roller 14 are mounted. Housing 11 is configured for use in a directional drilling apparatus as part of a drill head. In use, a rear end 15 of housing 11 is mounted on an impactor or sonde housing and is ultimately connected to a drill string by means of a starter rod. This connection may be made by any means already known in the art, such as a threaded connection. However, according to a preferred form of the invention, housing 11 has a socket therein which receives a splined projection in substantially the same manner as shown between the sonde housing and bit in co-pending, commonly assigned U.S. Ser. No. 09/373,395, filed Aug. 12, 1999 and PCT International Application No. US99/19331, filed Aug. 24, 1999, which applications are incorporated by reference herein for all purposes. In such an embodiment, transverse holes would be provided through housing 11 for the insertion of retaining pins such as solid pins or roll pins to hold bit 10 onto the adjoining section of the drill head assembly, most typically the front end of the sonde housing. Inclined rollers 12, 13 are keyed to the master spline of the sonde housing connection, so that the sonde accurately reports the position of rollers 12, 13 for purposes of steering.

Each inclined roller 12, 13 includes a rounded, typically truncated eggshell-shaped bit element 21 rotatably mounted on an axle 22. Bit element 21 is generally made of steel and preferably has an array of spaced tungsten carbide studs 23 thereon substantially uniformly distributed on the outer surface of bit element 21. However, bit elements 21 could also be integral steel elements with cutting projections. Each bit element has a rear opening 24 into which axle 22 is inserted. Internal bearings are provided to support each bit element on its axle in a manner already known in the art for tricone drill bits. The axis of rotation of each of rollers 12, 13 is angled both horizontally and vertically (or in both X and Y directions) relative to the lengthwise axis A of bit 10, such that each extends outwardly at an acute included angle relative to a lengthwise axis A of bit 10 (and housing 11.)

Figure 2:
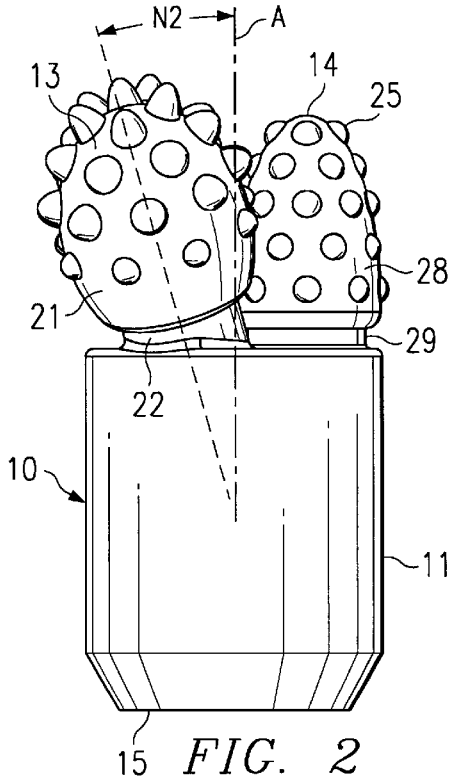
FIG. 2 is a side view of the drill bit of FIG. 1.
Figure 3:
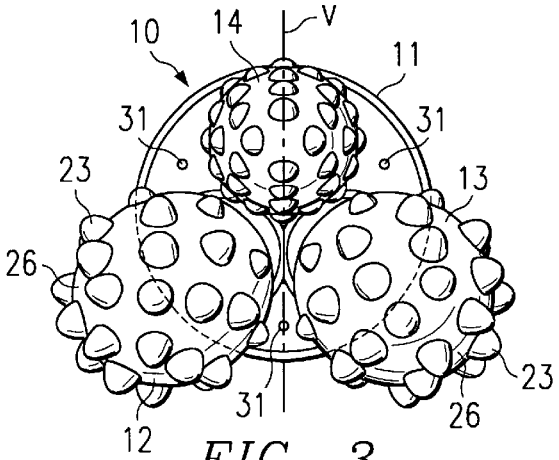
FIG. 3 is front view of the drill bit of FIG. 1.
Figure 4:
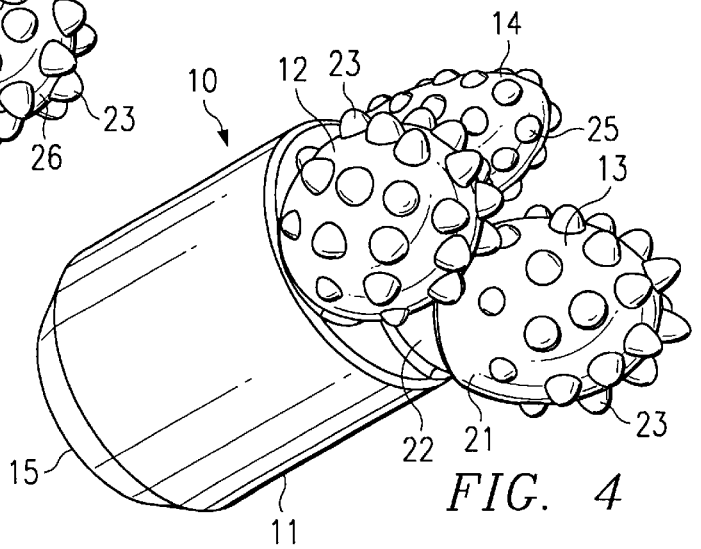
FIG. 4 is a side perspective view of the drill bit of FIG. 1.

As shown in FIG. 1, inclined rollers 12, 13 are preferably set at a first acute included angle N1, preferably from about 40 to 60°, relative to the lengthwise axis A of bit 10 in a horizontal or X direction. Rollers 12, 13 extend at equal and opposite angles relative to axis A in the horizontal or X direction as shown, giving bit 10 bilateral symmetry about a vertical plane V that bisects bit 10. As shown in FIG. 2, inclined rollers 12, 13 are preferably set at a second acute included angle N2 that is less than angle N1, preferably from about 20 to 40°, relative to the lengthwise axis A of bit 10 in a vertical or Y direction. Rollers 12, 13 preferably extend at the same angle and in the same direction in the vertical or Y direction. Such angles provide an overhanging, rounded outer surface portion 26 on each bit element 21, namely a crescent-shaped portion thereof which extends outside the outer periphery of bit housing 11. The actual surface so exposed changes as each bit element 21 rotates freely on its associated axle 22. Overhanging portions 26 define the diameter D of the hole created when the bit is boring straight ahead and rollers 12, 13 are rotated continuously 360 degrees about axis A.

Reaction roller 14 includes a bit element 28 provided with carbides 25 and an axle 29 on which bit element 28 is mounted. Since carbides 25 are optional and mainly intended to brace roller 14 against the wall of the borehole, carbides 25 are preferably less pointed and more rounded than carbides 23, which are configured to taper to a point and have a more conical shape than carbides 25. In the illustrated embodiment, the portion of each carbide 25 that protrudes out of the hole into which each carbide is set (e.g., by brazing) is hemispherical or nearly so. In contrast to rollers 12, 13, reaction roller 14 preferably sticks straight out in parallel to axis A, or at an acute angle relative to axis A less than the compound (X, Y) angle at which rollers 12, 13 extend from axis A. Roller 14 also has a lesser maximum widthwise diameter than inclined rollers 12, 13. Roller 14 has a maximum widthwise diameter which is about half the diameter of housing 11, and housing 11 has a diameter which is typically the same as or greater than that of the trailing components, the sonde housing, starter rod and drill string. Roller 14 may be the same length as or somewhat shorter than rollers 12, 13 as shown.

Figure 5:
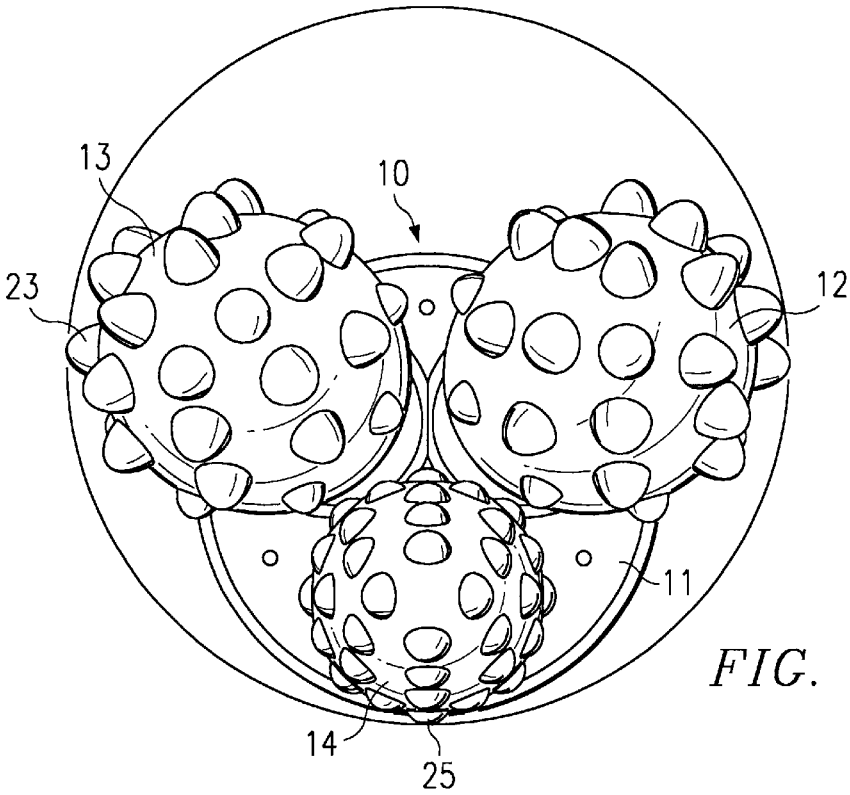
FIGS. 5 and 6 are front views illustrating the boring action of the drill bit of FIG. 1.
Figure 6:
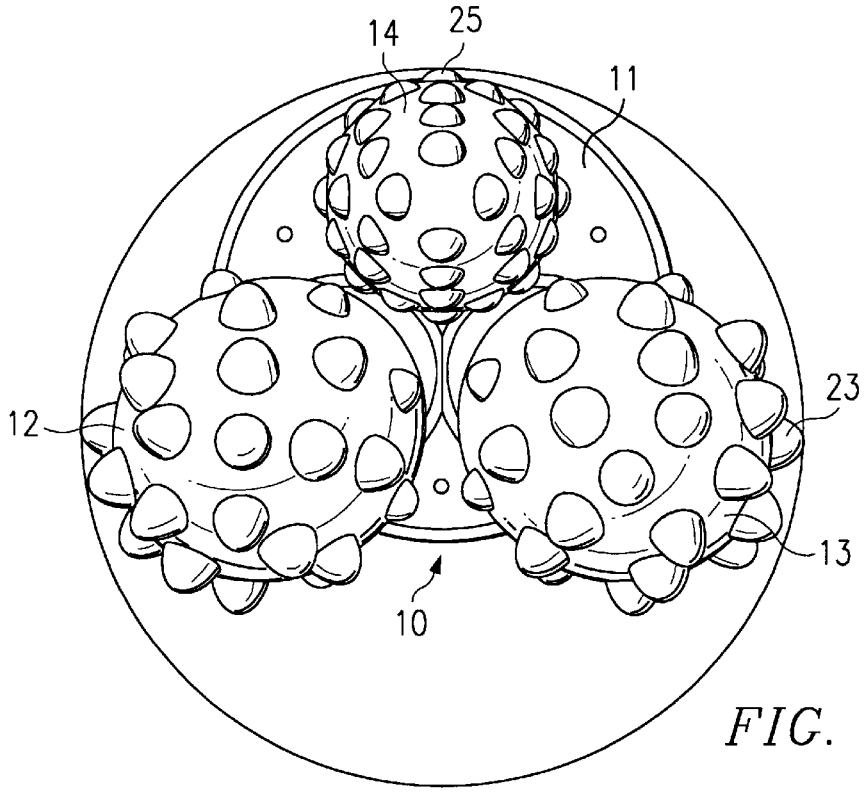

Referring to FIGS. 5 and 6, during straight ahead drilling, drill bit 10 revolves (spins) continuously and also moves along a circular path defined by the distance by which rollers 12, 13 protrude radially beyond the outer surface of housing 11. The borehole center is offset from axis A of the bit, and axis A revolves about the borehole center as illustrated in FIGS. 5 and 6. In general, the size of the borehole can be determined for a bit according to the invention by drawing a circle that coincides with (is tangent to) the outer surface of each of the rollers as shown. This unique motion permits reaction roller 14 to brace rollers 12, 13 for cutting even when roller 14 is not directly opposed (by 180°) to rollers 12, 13. Reaction roller 14 thus remains in contact the wall of the hole being drilled.

During steering, rollers 12, 13 are dragged back and forth over a limited arc of rotation (less than 360°), such as 30°–270°, especially 60°–120°, in order to deviate the borehole in the direction rollers 12, 13 are facing. Roller 14, particularly the carbides 25 thereof, extend slightly beyond the outer diameter of housing 11 as shown in order to engage the wall of the deviated borehole and provide a reaction surface for the other two rollers 12, 13. Lacking such a reaction roller 14, housing 11 itself would have to act as the reaction surface and be subject to much more rapid wear. Unlike the bit with cylindrical teeth described in the foregoing co-pending applications, bit 10 of the present invention does not rely on a sloped front face in order to steer, and does not require providing the housing with carbides in order to protect the base metal.

Bit 10 is provided with drilling fluid through internal passages substantially like those discussed in the applications incorporated by reference above. Placement of fluid ejection ports 31 is not critical, and there may be one or more such ports. The volume of fluid ejected is much less than the amount required to run a mud motor, namely just enough to lubricate the hole, cool the bit and carry away cuttings and spoil.

The specific size, shape and arrangement of rollers 12–14 may vary substantially. A symmetrical arrangement is preferred, such as disposing each roller equiangularly relative to the other two when the axes are viewed radially (in a plane perpendicular to axis A, 120° in FIG. 3.) A two-roller configuration with only one inclined roller and one reaction roller is within the scope of the invention, although less effective for drilling than the three roller bit described herein. A three-roller configuration with one inclined roller 12 and a pair of symmetrically positioned reaction rollers 14 is also within the scope of the invention. (In effect, roller 13 is replaced by an additional roller 14 in the embodiment shown.) If only one inclined cutting roller is provided, the preferred arc of rotation for steering will be greater, for example, from 90–270°. Such a bit can effectively bore through soil, cobble and rock using the same drilling action in each, rather than relying on a push or push-and-turn action in combination with a sloped bit face to steer in soil as presently practiced in the art. The invention thus provides a single bit of high durability and low cost, and eliminates the widely recognized need for a separate bit style for use when cobble conditions are encountered. While certain embodiments of the invention have been illustrated for the purposes of this disclosure, these and other changes in the method and apparatus of the invention presented herein may be made by those skilled in the art, such changes being embodied within the scope and spirit of the present invention as defined in the appended claims.

What is claimed is:

1. A drill bit for directional drilling, comprising:

a housing including means at a rear end thereof for mounting the bit on a trailing component of a drill head, and passages for ejection of drilling fluid into a borehole;

a first axle mounted to extend forwardly from a front end of the housing;

a first roller rotatably mounted on the first axle having cutting projections thereon, which first roller extends outside of the outer diameter of the housing by a distance which defines the size of the borehole when the drill bit is rotated over 360 degrees;

a second axle mounted to extend forwardly from a front end of the housing;

a second roller rotatably mounted on the second axle, which second roller extends outside of the outer diameter of the housing by a distance less than the distance the first roller extends outside of the housing and which is configured to provide a reaction surface for the first roller as the first roller bores the borehole with the cutting projections.

2. The drill bit of claim 1, wherein the first roller and first axle extend outwardly at an acute included angle relative to a lengthwise axis of the housing.

3. The drill bit of claim 2, wherein the second roller and second angle extend straight out in parallel with the lengthwise axis of the housing.

4. The drill bit of claim 1, wherein the cutting projections are pointed carbide studs.

5. The drill bit of claim 1, further comprising a third axle and third roller substantially identical to the first axle and first roller.

6. The drill bit of claim 5, wherein the first and third rollers are disposed on opposite sides of a vertical plane bisecting the bit, and diverge symmetrically.

7. The drill bit of claim 6, wherein the second roller and second axle have an lengthwise axis parallel to and offset from the lengthwise axis of the housing.

8. The drill bit of claim 1, further comprising a third axle and third roller substantially identical to the first axle and first roller, wherein the first and third rollers are disposed on opposite sides of a vertical plane bisecting the bit and the second roller.

9. The drill bit of claim 1, wherein the first and second rollers have a truncated egg shape.

10. The drill bit of claim 1, wherein the second roller extends outside of the outer diameter of the housing by a slight distance just sufficient to provide the reaction surface.

11. The drill bit of claim 1, wherein the second roller extends outside of the outer diameter of the housing by a slight distance just sufficient to provide the reaction surface, and the first roller extends outside of the outer diameter of the housing by a distance substantial enough to define a crescent-shaped portion that extends outside of the outer diameter of the housing, which crescent shaped portion has a plurality of the cutting projections thereon.

12. The drill bit of claim 11, wherein some of the cutting projections on the crescent-shaped portion of the first roller are positioned entirely outside of the outer diameter of the housing.

13. The drill bit of claim 1, further comprising a third axle and third roller substantially identical to the first axle and first roller, wherein the first and third rollers are disposed on opposite sides of a vertical plane bisecting the bit and the second roller, wherein the second roller extends outside of the outer diameter of the housing by a slight distance just sufficient to provide the reaction surface, and the first and third rollers extend outside of the outer diameter of the housing by a distance substantial enough to define crescent-shaped portions that extend outside of the outer diameter of the housing, which crescent shaped portions each have a plurality of cutting projections thereon.

14. The drill bit of claim 13, wherein the cutting projections comprise carbide studs mounted in the rollers.

15. The drill bit of claim 2, wherein the acute included angle is in the range of 40 to 60 degrees.

16. A method of drilling using a drill bit for directional drilling that includes a housing including means at a rear end thereof for mounting the bit on a trailing component of a drill head and passages for ejection of drilling fluid into a borehole, a first axle mounted to extend forwardly from a front end of the housing, a first roller rotatably mounted on the first axle having cutting projections thereon, which first roller extends outside of the outer diameter of the housing by a distance which defines the size of the borehole when the drill bit is rotated over 360 degrees, a second axle mounted to extend forwardly from a front end of the housing, and a second roller rotatably mounted on the second axle, which second roller extends outside of the outer diameter of the housing by a distance less than the distance the first roller extends outside of the housing and which is configured to provide a reaction surface for the first roller as the first roller bores the borehole with the cutting projections, which method comprises the steps of:

drilling straight while continuously rotating the bit with the first and second rollers in tangent contact with an inner surface of a borehole being formed; and deviating the borehole by drilling with the bit over a limited arc of rotation with the first and second rollers in tangent contact with an inner surface of a borehole being formed.

17. The method of claim 16, wherein the deviating step further comprises moving the first roller back and forth over the limited arc of rotation.

18. The method of claim 16, wherein the bit further comprises a third axle and third roller substantially identical to the first axle and first roller, wherein the first and third rollers are disposed on opposite sides of a vertical plane bisecting the bit and the second roller, wherein the second roller extends outside of the outer diameter of the housing by a slight distance just sufficient to provide the reaction surface, and the first and third rollers extend outside of the outer diameter of the housing by a distance substantial enough to define crescent-shaped portions thereof that extend outside of the outer diameter of the housing, which crescent shaped portions each have a plurality of the cutting projections thereon, and the step of drilling straight further comprises keeping the first, second and third rollers in tangent contact with an inner surface of a borehole being formed, and during which the bit moves in a circular path along a wall of the borehole.

19. A drill bit for directional drilling, comprising:

a housing including means at a rear end thereof for mounting the bit on a trailing component of a drill head and passages for ejection of drilling fluid into a borehole;

a first axle mounted to extend forwardly from a front end of the housing;

a first roller rotatably mounted on the first axle having first studs thereon, which first roller extends outside of the outer diameter of the housing by a distance which defines the size of the borehole when the drill bit is rotated over 360 degrees;

a second axle mounted to extend forwardly from a front end of the housing; and a second roller rotatably mounted on the second axle having second studs mounted thereon, which second roller is configured to provide a reaction surface for the first roller as the first roller bores the borehole with the first studs, wherein the first studs are more pointed than the second studs.

20. The drill bit of claim 19, wherein the second roller extends outside of the outer diameter of the housing by a distance less than the distance the first roller extends outside of the outer diameter of the housing.

* * * * *